US008021247B2

(12) United States Patent
Brolly

(10) Patent No.: US 8,021,247 B2
(45) Date of Patent: Sep. 20, 2011

(54) HIGH-PRECISION GOLF CLUB

(76) Inventor: Louis Philippe Brolly, Le Landeron (CH)

( * ) Notice: Subject to any disclaimer, the term of this patent is extended or adjusted under 35 U.S.C. 154(b) by 0 days.

(21) Appl. No.: 12/484,573

(22) Filed: Jun. 15, 2009

(65) Prior Publication Data

US 2009/0253528 A1 Oct. 8, 2009

Related U.S. Application Data

(63) Continuation of application No. PCT/CH2007/000632, filed on Dec. 13, 2007.

(30) Foreign Application Priority Data

Dec. 18, 2006 (CH) ..... 2046/06

(51) Int. Cl.
*A63B 53/00* (2006.01)

(52) U.S. Cl. ..... 473/340; 473/300; 473/251; 473/314; 473/328

(58) Field of Classification Search ..... 473/300–303, 473/251, 328, 340–341
See application file for complete search history.

(56) References Cited

U.S. PATENT DOCUMENTS

| | | | | | |
|---|---|---|---|---|---|
| 1,531,821 | A | * | 3/1925 | Scott | 473/328 |
| 4,000,902 | A | | 1/1977 | Perkins | |
| 4,065,133 | A | * | 12/1977 | Gordos | 473/327 |
| 4,919,428 | A | | 4/1990 | Perkins | |
| 4,962,931 | A | * | 10/1990 | Jazdzyk, Jr. | 473/252 |
| 5,133,555 | A | * | 7/1992 | Bailey | 473/201 |
| 5,152,533 | A | * | 10/1992 | Radakovich | 473/206 |
| 5,299,846 | A | * | 4/1994 | Rush | 294/19.2 |
| 5,328,174 | A | * | 7/1994 | Reeder | 473/239 |
| 5,597,364 | A | * | 1/1997 | Thompson | 473/314 |
| 5,607,365 | A | * | 3/1997 | Wolf | 473/328 |
| 5,704,851 | A | * | 1/1998 | Lucetti | 473/328 |
| 5,749,793 | A | * | 5/1998 | Lucetti | 473/324 |
| 5,893,804 | A | | 4/1999 | Pan | |
| 5,938,538 | A | * | 8/1999 | Broadbridge et al. | 473/252 |
| 5,957,782 | A | | 9/1999 | Madara | |
| 5,967,902 | A | * | 10/1999 | Greenquist et al. | 473/253 |
| 6,155,930 | A | * | 12/2000 | Madara | 473/226 |
| 6,626,768 | B2 | * | 9/2003 | Roelke | 473/296 |
| 6,739,980 | B2 | * | 5/2004 | Scott et al. | 473/200 |
| D523,508 | S | * | 6/2006 | Shenoha | D21/759 |
| D531,245 | S | * | 10/2006 | Shenoha | D21/759 |
| 2003/0013539 | A1 | * | 1/2003 | Scott et al. | 473/251 |
| 2003/0083142 | A1 | * | 5/2003 | Nam | 473/286 |
| 2004/0185955 | A1 | * | 9/2004 | Rocconi | 473/241 |
| 2004/0259655 | A1 | * | 12/2004 | Ferris | 473/251 |
| 2005/0026712 | A1 | * | 2/2005 | Byrd et al. | 473/300 |
| 2005/0159238 | A1 | * | 7/2005 | Lu | 473/300 |
| 2009/0082120 | A1 | * | 3/2009 | Johnson | 473/202 |

FOREIGN PATENT DOCUMENTS

WO 2006136048 A 12/2006

OTHER PUBLICATIONS

International Search Report dated Apr. 2, 2008.

* cited by examiner

*Primary Examiner* — Stephen L. Blau
(74) *Attorney, Agent, or Firm* — Pearne & Gordon LLP

(57) ABSTRACT

The invention relates to a device for a golf club providing an excellent orientation of the club head in the target direction. The disclosed golf club comprises a head having a striking surface, a grip having a butt end, and a shaft connecting the head at its upper end, and the grip at its lower end; wherein the butt end comprises an aiming notch oriented perpendicular to the plane of zero loft of the striking surface, and wherein the head comprises stabilizing profiles on its lower face.

4 Claims, 4 Drawing Sheets

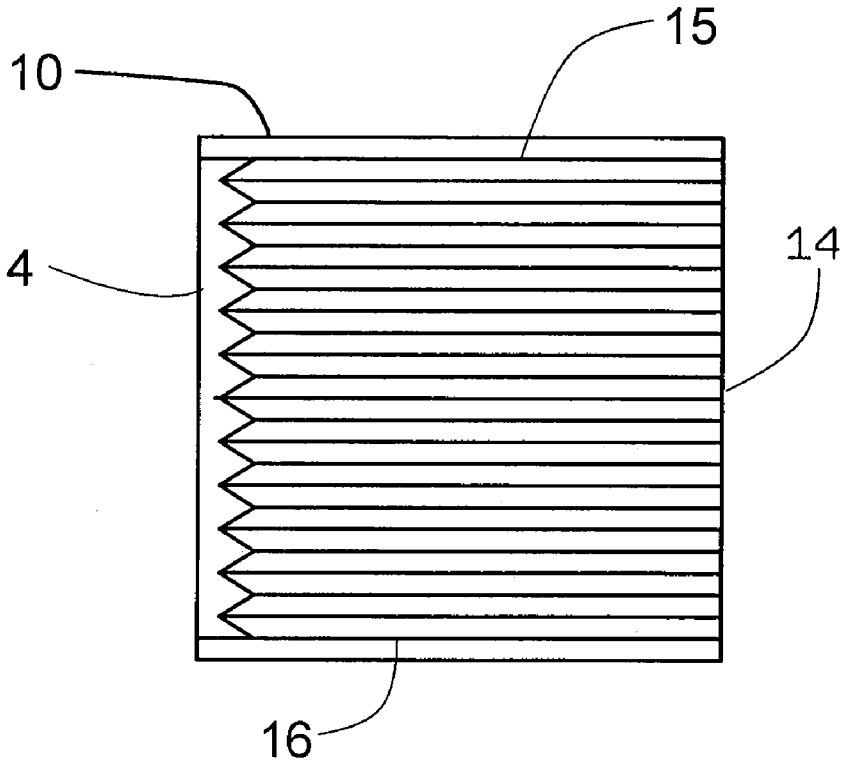
Fig. 10
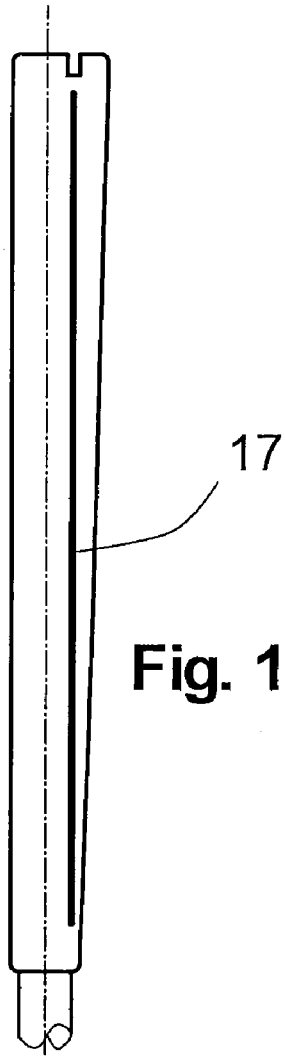
Fig. 11
Fig. 12
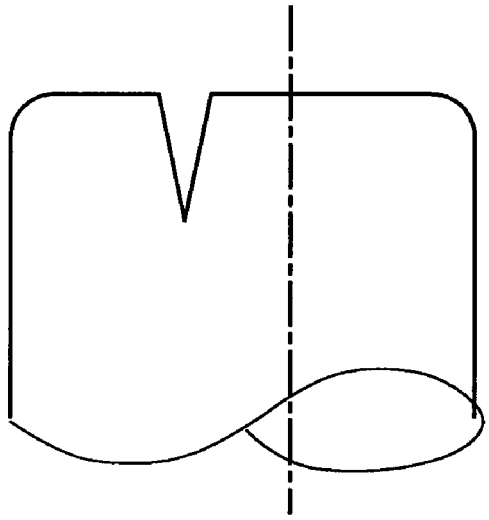

HIGH-PRECISION GOLF CLUB

REFERENCE DATA

This application is a continuation of International Patent Application PCT/CH2007/000632 (WO2008/074173) filed on Dec. 13, 2007, claiming priority of CH2046/06 of Dec. 18, 2006, the contents whereof are hereby incorporated.

FIELD OF THE INVENTION

The present disclosure relates to a golf club. More particularly, the present disclosure relates to a golf club allowing for an excellent orientation of a striking surface of a golf club head in the target direction.

DESCRIPTION OF RELATED ART

There already are devices whose purpose is to improve putting accuracy. The innovations concern mainly the adjunction of lines on a putter head. This enables a player to be well positioned in relation to the putter, but hardly improves the orientation of a striking surface in the desired direction. One can also mention the adjunction of a small cross (not shown) on the upper end of a grip of the golf club, the end called 'but end'. One of the lines is parallel to the striking surface and the other is perpendicular to the striking surface. The latter is an additional aid to orientation, similar to the line situated on the top of the putter head. But it is also used by the player in address position, i.e. the player's head is above the small cross; accuracy is thus hardly better than with the line.

BRIEF SUMMARY OF THE INVENTION

The disclosed golf club allows for an excellent orientation of a striking surface of a golf club head in the target direction.

As illustrated by the preferred embodiments, the disclosed golf club comprises a head having a striking surface, a grip having a butt end at its upper extremity, and a shaft connecting the head at its lower end, and the grip at its upper end; wherein the butt end comprises an aiming notch oriented perpendicular to the plane of zero loft of the striking surface, and wherein the head comprises stabilizing profiles on its lower face.

The grip of the golf club can further comprise at least one reference line extending from the aiming notch along the grip, parallel with the shaft axis, allowing a player to maintain maximum accuracy in the orientation of the striking surface for short-length putts.

BRIEF DESCRIPTION OF THE DRAWINGS

The invention will be better understood with the aid of the description of an embodiment given by way of example and illustrated by the figures, in which:

FIG. 10 represents a particular shape of putter head;

FIG. 11 represents the reference line on the grip; and

FIG. 12 represents an aiming notch of triangular section.

DETAILED DESCRIPTION OF POSSIBLE EMBODIMENTS OF THE INVENTION

Figure 1:
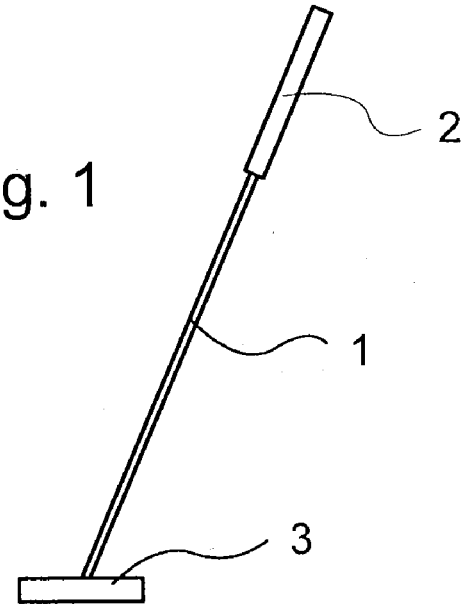
FIG. 1 represents the principal elements of a putter.

FIG. 1 represents the principal elements of a putter. A shaft 1 comprises at its upper end a grip 2. It is through the grip 2 that the player holds the putter. At the lower end of the shaft 1 a head 3 of the putter is attached.

Figure 2:
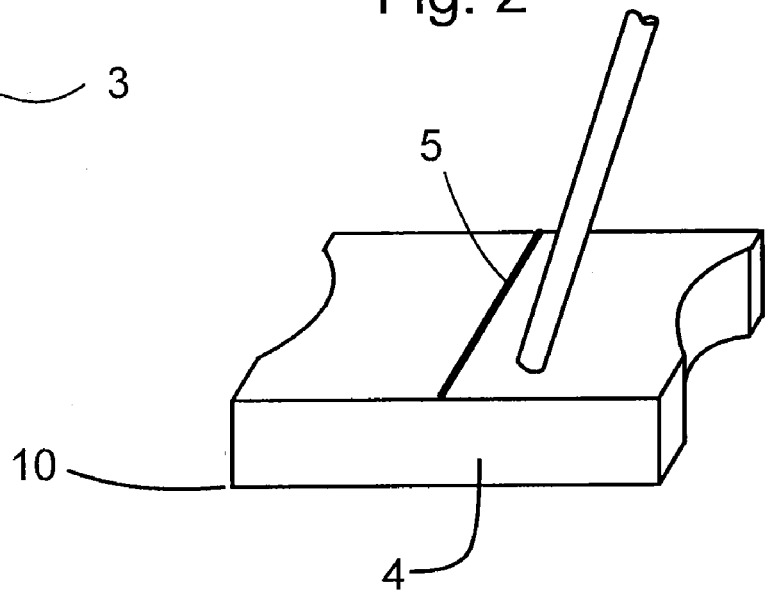
FIG. 2 represents a commonly used putter head.

FIG. 2 shows some details of a commonly used putter head. The side turned towards the objective is a surface called a striking surface 4; it touches the ball at the moment of striking. A line 5 is marked on the top of the putter head. This line 5 has, at the moment of address, two functions. On the one hand, it indicates the zone of the striking surface 4 that must touch the ball, also called 'sweet-spot'. On the other hand, it is an aid for orienting the putter head in the target direction at the moment of address. However, since the player's eyes are on the order of 1.50 m above the putter head, the accuracy achieved by using this line 5 is poor.

Figure 3:
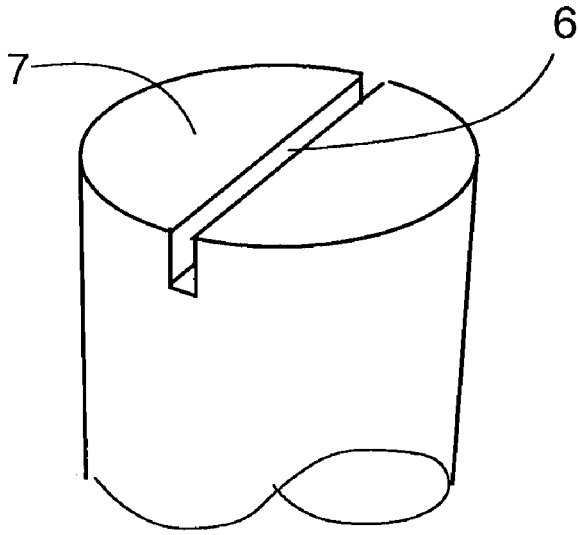
FIG. 3 represents an embodiment of the aiming notch.

In an embodiment represented in FIG. 3, an aiming notch 6, i.e. a small rectilinear notch, is gouged in the upper extremity, or the butt end 7, of the grip 2. The aiming notch 6 extends through the entire butt end and is parallel to the line 5. In order to aim, the player positions himself behind the ball, holds the shaft 1 vertically, with the putter head 3 touching the green, and visually aligns the aiming notch 6 in the target direction. Once in address position, the striking surface 4 is then oriented in the target direction with very good accuracy.

Figure 9:
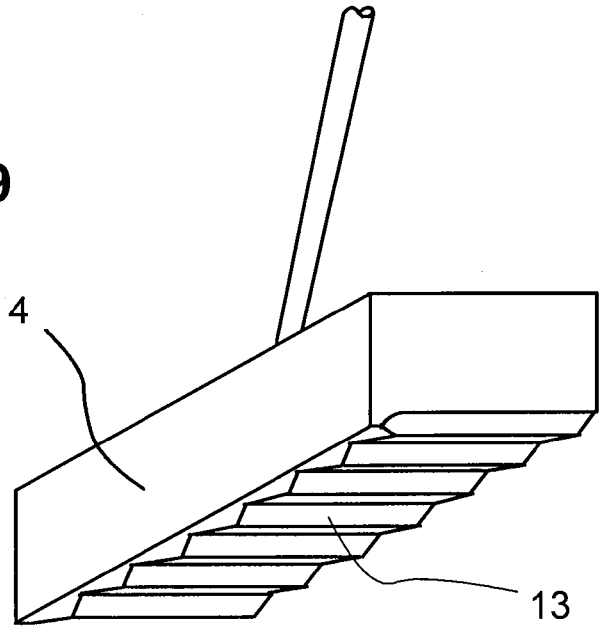
FIG. 9 gives an example of stabilizing profiles.

In another embodiment shown in FIG. 9, so-called stabilizing profiles 13 are comprised on the lower face of the head 3. These stabilizing profiles 13 ensure that the correct orientation of the striking surface 4, when the putter head 3 is placed on the ground, is maintained. Here, the stabilizing profiles 13 can be notches, ribs, grooves, or any other shapes able to maintain the correct orientation of the striking surface 4 when the putter head 3 is placed on the ground.

This direct aim is similar to that used with a gun, i.e. the aiming notch 6 is made to coincide with the line of sight going from the dominant eye to the target point. It is this true aim that produces the best orientation accuracy of the striking surface 4.

Figure 4:
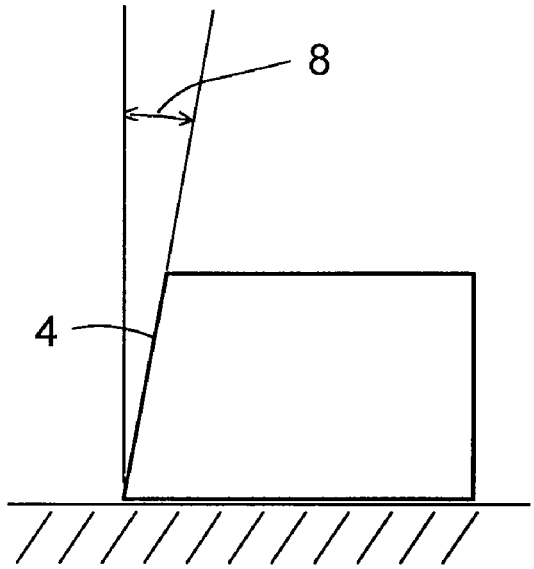
FIG. 4 defines the loft.

In the example of FIG. 3, the rectilinear aiming notch 6 crosses the grip butt-end 7. The aiming notch 6 is perpendicular to the plane of 'zero loft', i.e. to the plane of the striking surface 4 if the loft were zero. The loft, as indicated in FIG. 4, is the angle 8 formed by the striking surface 4 with a line perpendicular to the ground when the putter head 3 is placed on the ground. For common putters, the loft is of several degrees, which gives a striking surface 4 directed slightly skywards.

Figure 5:
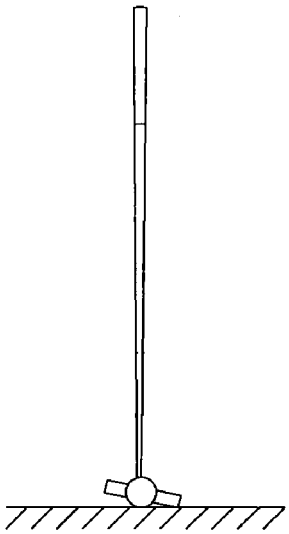
FIG. 5 shows the position of the grip during aiming.

The aiming is achieved in the following way. The player places himself behind the ball, for example crouching, and lets the putter hang whilst holding it by the top of the grip 2, with his arm stretched forward. The player positions the striking surface 4 just behind the ball and puts a toe 10 (see FIG. 2) of the putter head 3 onto the green. FIG. 5 shows the position of the putter relative to the ball at this stage of the aiming process. In this position, the shaft 1 is vertical and the aiming notch 6 is vertically above the ball center. The player moves his head laterally to align his dominant eye with the target point and with the zone of the aiming notch 6, and then pivots the putter shaft 1 around the shaft axis until the aiming notch 6 can be seen end-to-end. The striking surface 4 is then well oriented. An example of what the player sees in the case of a long putt when the putter is well oriented is given by FIG. 6. In this example, the target point is a flag 9.

Figure 8:
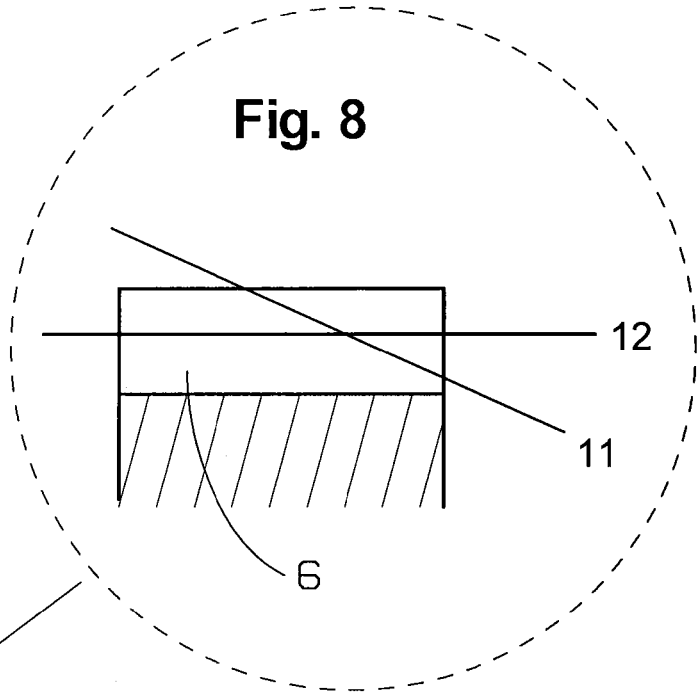
FIG. 8 is an enlargement of FIG. 7 in the zone of the aiming notch.
Figure 7:
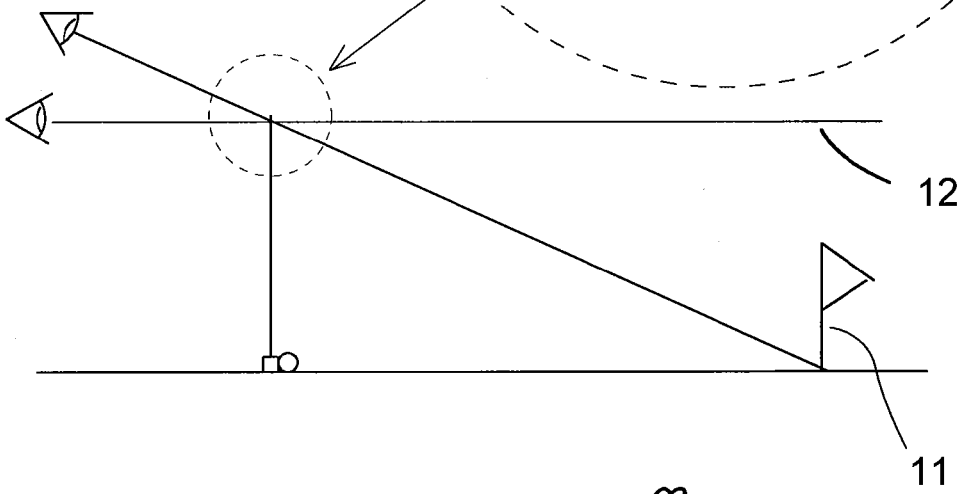
FIG. 7 represents the position of the dominant eye for two putt lengths.

The aiming is possible for all putt lengths, but the position of the dominant eye depends on the putt length. FIG. 7 shows two examples of positions of the dominant eye according to the putt length. The position 11 of the target point corresponds to a putt of about 2 m, and the position 12 to a putt of great length. FIG. 8 is an enlargement of the butt end zone of FIG. 7. It shows how the alignment lines of positions 11 and 12, respectively are situated in the aiming notch 6 for the two distances of FIG. 7.

Once the orientation has been performed, the player must pivot the putter head 3 to bring the entire lower face of the putter head 3 onto the green in address position whilst maintaining the correct orientation of the striking surface 4 towards the target point.

Maintaining the correct orientation is ensured thanks to stabilizing profiles 13 (see FIG. 9) added to the lower face of the putter head 3. Among the stabilizing profiles 13, it is principally a stabilizing profiles 15 on the toe side that will ensure that the orientation is maintained. An example of stabilizing profiles 13 is given by FIG. 9. These stabilizing profiles 13 are preferably perpendicular to the striking surface 4. The stabilizing profiles 13, comprising the stabilizing profile 15 on the toe side, extend from the striking surface to a rear side 14 of the putter head 3.

Maximum aiming accuracy is achieved when the aiming notch 6 is, during aiming in the vertical aiming plane, going through the center of the ball. On the other hand, once the lower face of the putter head 3 has been placed on the ground, the sweet-spot must be opposite the center of the ball. To satisfy these two constraints, the aiming notch 6 is offset by about 5 to 10 mm on the player's side relative to the shaft axis. The exact value is according to the dimensions of the putter head 3.

The example of FIG. 10 represents a bottom view of a very elongated putter head 3 between the striking surface 4 and the rear side 14, with the stabilizing profiles 13 perpendicular to the striking surface 4. The stabilizing profile 15 on the side of the toe 10 ensures that the orientation of the striking surface 4 during pivoting from the end of aiming to the address is maintained.

In yet another embodiment, as the central stabilizing profiles are only of reduced use, they can be omitted, leaving only two of the profiles 13, the stabilizing profile 15 and a symmetric profile 16, on the side opposed to the toe side.

In yet another embodiment represented in FIG. 11, a line, called in this document reference line 17, is added on the grip 2. The reference line 17, is at the intersection of the grip 2 with the plane going through the aiming notch axis and parallel to the shaft axis. In other words, the reference line 17 extends along the grip 2 from the aiming notch 6, parallel with the shaft axis. In a variant of the embodiment, the grip 2 comprises two reference lines 17, one on each side of the grip 2. For example, one reference line 17 can be used for right-handed players and the other reference line 17 for left-handers. As indicated in FIG. 11, the reference line 17 is viewed rectilinear during aiming, and materializes the vertical plane of the aiming notch 6. The reference line 17 allows the player to maintain maximum accuracy corresponding to the line 12 of FIG. 7 for short-length putts. For this, the player positions his head laterally until the target point is estimated to be behind the reference line 17.

Figure 6:
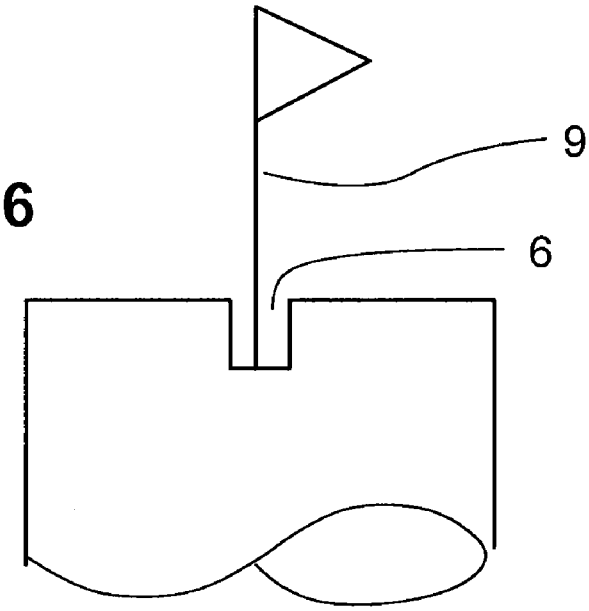
FIG. 6 gives an example of correct orientation.

FIGS. 3 and 6 show an aiming notch 6 of rectangular section. In a variant, the aiming notch 6 has a triangular section, as shown in FIG. 12. This type of aiming notch 6 with a triangular section makes it easier to achieve correct orientation.

The combination of the aiming notch 6 in the butt end 7 of the grip 2 and of the stabilizing profiles 13 on the lower face of the putter head 3 considerably increases, compared to traditional putters, the orientation accuracy of the putter head 3 at address, and thus improves the putting success rate. Since half of the shots occur on the green, this combination will produce a significant improvement of the score.

It is understood that the present invention is not limited to the exemplary embodiments described above and other examples of implementations are also possible within the scope of the patent claims For example, the adjunction of the aiming notch 6 and of the stabilizing profiles 13 is not limited to putters, i.e. the golf club used on the green, but can also be implemented on all types of golf clubs.

The putter or golf club disclosed herein provides an excellent orientation of the striking surface 4 in the target direction.

REFERENCE NUMBERS

1 shaft
2 grip
3 putter head
4 striking surface
5 line
6 aiming notch
7 butt end
8 angle
9 flag
10 toe
11 position of the target point for a putt of about 2 m
12 position of the target point for a putt of great length
13 stabilizing profiles
14 rear side of the putter head
15 stabilizing profile on the toe side
16 symmetric profile
17 reference line

The invention claimed is:

1. A golf club comprising:
a head having a striking surface,
a grip having a butt end, and
a shaft, its lower end connecting the head and its upper end connecting the grip;
wherein the butt end comprises an aiming notch oriented perpendicular to the plane of zero loft of the striking surface,
wherein the head comprises stabilizing profiles on its lower face in the form of ridges protruding from the lower face, wherein a ridge of the ridges protrudes from a toe end of the lower face forming a pointed peak.

2. The golf club according to claim 1, wherein the stabilizing profile on the toe end is perpendicular to the striking surface.

3. The golf club according to claim 2, wherein the stabilizing profile on the toe end of the lower face extends substantially from the striking surface to the rear side of the putter head.

4. The golf club according to claim 1, wherein the stabilizing profile on the toe end of the lower face extends substantially from the striking surface to the rear side of the putter head.

* * * * *